US005971196A

United States Patent [19]

Gamache

[11] Patent Number: 5,971,196

[45] Date of Patent: Oct. 26, 1999

[54] PARTITIONED COLLECTION CONTAINER

[75] Inventor: Denis Gamache, Saint-Rédempteur, Canada

[73] Assignee: C.S. Gestion de Déchets et de Matiere Recyclable Inc., St-Nicolas, Canada

[21] Appl. No.: 09/056,756

[22] Filed: Apr. 8, 1998

[51] Int. Cl.[6] ..... B65F 1/16

[52] U.S. Cl. ..... 220/524; 220/909

[58] Field of Search ..... 220/908, 909, 220/524, 525, 254, 1.5, 263, 326, 342; 232/43.1

[56] References Cited

U.S. PATENT DOCUMENTS

| | | | |
|---|---|---|---|
| 4,088,071 | 5/1978 | Cruse et al. . | |
| 5,015,142 | 5/1991 | Carson . | |
| 5,015,143 | 5/1991 | Carson . | |
| 5,035,563 | 7/1991 | Mezey . | |
| 5,058,957 | 10/1991 | Fell | 220/908 |
| 5,098,250 | 3/1992 | Carson . | |
| 5,119,957 | 6/1992 | Joyce-Middaugh . | |
| 5,139,299 | 8/1992 | Smith . | |
| 5,171,119 | 12/1992 | Carson | 220/909 |
| 5,176,488 | 1/1993 | Boda . | |
| 5,181,619 | 1/1993 | Noble . | |
| 5,244,218 | 9/1993 | Irwin, Sr. . | |
| 5,251,775 | 10/1993 | Kruzick et al. | 220/908 |
| 5,275,522 | 1/1994 | Garrett, Jr. et al. . | |
| 5,458,452 | 10/1995 | Pellegrini . | |
| 5,490,606 | 2/1996 | Lombardo . | |
| 5,525,020 | 6/1996 | Reiling . | |
| 5,681,140 | 10/1997 | Christenson . | |

FOREIGN PATENT DOCUMENTS

| | | | |
|---|---|---|---|
| 645480 | 1/1994 | Australia | 220/524 |

*Primary Examiner*—Stephen Castellano
*Attorney, Agent, or Firm*—Goudreau Gage Dubuc & Martineau Walker

[57] ABSTRACT

A partitioned collection container including a central compartment and two lateral compartments is described herein. A first lid is pivotally mounted to close the central compartment and third and second lids are pivotally mounted to respectively close the two lateral compartments. A lid locking mechanism is provided. The lid locking mechanism has two positions. In a first position, the lid locking mechanism allows the first lid to open while preventing the second and third lids from opening. Conversely, in a second position, the lid locking mechanism allows the second and third lid to open while preventing the first lids from opening.

7 Claims, 7 Drawing Sheets

PARTITIONED COLLECTION CONTAINER

FIELD OF THE INVENTION

The present invention relates to collection containers. More specifically, the present invention is concerned with a partitioned collection container provided with lids that may be separately open.

BACKGROUND OF THE INVENTION

Partitioned collection containers are known in the art. They are conventionally used to collect recyclable and/or non-recyclable waste material.

For example, U.S. Pat. No. 5,458,452 issued to Louis A. Pellegrini on Oct. 17, 1995 and entitled: "VEHICLE AND METHOD FOR COLLECTING RECYCLABLE WASTE MATERIAL" describes a three-compartment vehicle used to collect different types of recyclable material. A three-compartment container is used to keep the recycled material segregated between collections. When the vehicle lifts the container, the compartments of the container are aligned with the compartment of the vehicle to therefore transfer the different types of recyclable material from the compartments of the container to the appropriate compartments of the vehicle.

The vehicle and method described by Pellegrini has many drawbacks. For example, since the three lids of the compartments of the container open simultaneously and since the distance separating the compartment is relatively small, the separation of the different types of recyclable material in the vehicle may not be sufficient. Furthermore, the dimensions of the compartments of the vehicle must be carefully balanced to ensure that they will fill at approximately the same rate.

U.S. Pat. No. 5,490,606 issued to Santo J. Lombardo on Feb. 13, 1996 and entitled: "REFUSE CONTAINER FOR SEGREGATING REFUSE AND TRUCK ATTACHMENT FOR USE IN CONNECTION THEREWITH" describes a two-compartment container provided with separate lids that may selectively be locked before the transfer of the refuse from the container to a refuse collecting vehicle. An actuator is provided on the refuse collecting vehicle to actuate one of two locking mechanisms used to prevent the lids from opening. Each locking mechanism is under the form of an eccentric element rotating under the pressure of the actuator and engaging a projection of a respective lid. This engagement prevent the lid from opening when the container is manipulated by the refuse collecting vehicle.

The container of Lombardo, while being an improvement over the container of Pellegrini since it provides means for selectively lock one of the lids, suffers from various drawbacks. For example, the lids must be properly closed for the locking mechanisms to operate adequately. Indeed, if the projection of the lid is too far from its normal position, the eccentric element will not contact it and the lid will open. This could be caused by refuse or other material so positioned between the lid and the container to prevent adequate closure of the lid. Furthermore, the locking mechanisms and/or the projection of the lids may be damaged if they are inadequately positioned when the locking mechanism attempts to engage the projection of the lid.

OBJECTS OF THE INVENTION

An object of the present invention is therefore to provide an improved partitioned collection container.

SUMMARY OF THE INVENTION

More specifically, in accordance with the present invention, there is provided a partitioned collection container comprising:

a body provided with a front wall, a rear wall, two lateral side walls and a bottom wall; the body also including two internal partition walls defining a first compartment, a second compartment and a third compartment; the first compartment being a central compartment and the second and third compartments being lateral compartments;

a first lid hingedly connected to the body; the first lid is pivotable between a closed position where it closes the first compartment and an open position;

a second lid hingedly connected to the body; the second lid is pivotable between a closed position where it closes the second compartment and an open position;

a third lid hingedly connected to the body; the third lid is pivotable between a closed position where it closes the third compartment and an open position;

lid locking mechanism mounted to the body; the lid locking mechanism being associated with the first, second and third lids to allow one of the first lid or the second and third lids to open.

According to another aspect of the present invention, there is provided a partitioned collection container comprising:

a body provided with a front wall, a rear wall, two lateral side walls and a bottom wall; the body also including two internal partition walls defining a first compartment, a second compartment and a third compartment; the first compartment being a central compartment and the second and third compartments being lateral compartments;

a cover provided with first, second and third apertures respectively open to the first, second and third compartments;

a first lid hingedly connected to the cover; the first lid is pivotable between a closed position where it closes the first compartment and an open position; the first lid including a projecting lip;

a second lid hingedly connected to the cover; the second lid is pivotable between a closed position where it closes the second compartment and an open position; the second lid including a projecting pin;

a third lid hingedly connected to the cover; the third lid is pivotable between a closed position where it closes the third compartment and an open position; the third lid including a projecting pin; and lid locking mechanism mounted to the body and including:

first and second push-bars pivotally mounted to the front wall of the body; the first and second push-bars being pivotable between a retracted position and an extended position;

first and second push-rods respectively connected to the first and second push-bars so that the pivoting of the push-bars between the retracted and extended positions cause the longitudinal displacement of the push-rods between respective unlocking and locking positions; each the first and second push-rod being provided with a pin locking element configured, sized and positioned to engage the projecting pin of one of the second and third lids when the first and second push-rods are in the locking position; and a cross-bar provided between the first and second push-bars and positioned to engage the projecting lip of the first lid when the first and second push-bars are in the retracted position to thereby prevent the first lid from opening;

whereby (a) when the first and second push-bars are in the retracted position the cross-bar prevent the first lid from pivoting to the open position and the first and second push-rods are in the unlocking position, therefore allowing the second and third lids to pivot to their respective open positions; and (b) when the first and second push-bars are in the extended position the cross-bar does not engage the projecting lip, therefore allowing the first lid to pivot to the open position and the first and second push-rods are in the locking position, therefore preventing the second and third lids from pivoting to their respective open positions.

Other objects, advantages and features of the present invention will become more apparent upon reading of the following non restrictive description of preferred embodiments thereof, given by way of example only with reference to the accompanying drawings.

DESCRIPTION OF THE PREFERRED EMBODIMENT

Figure 1:
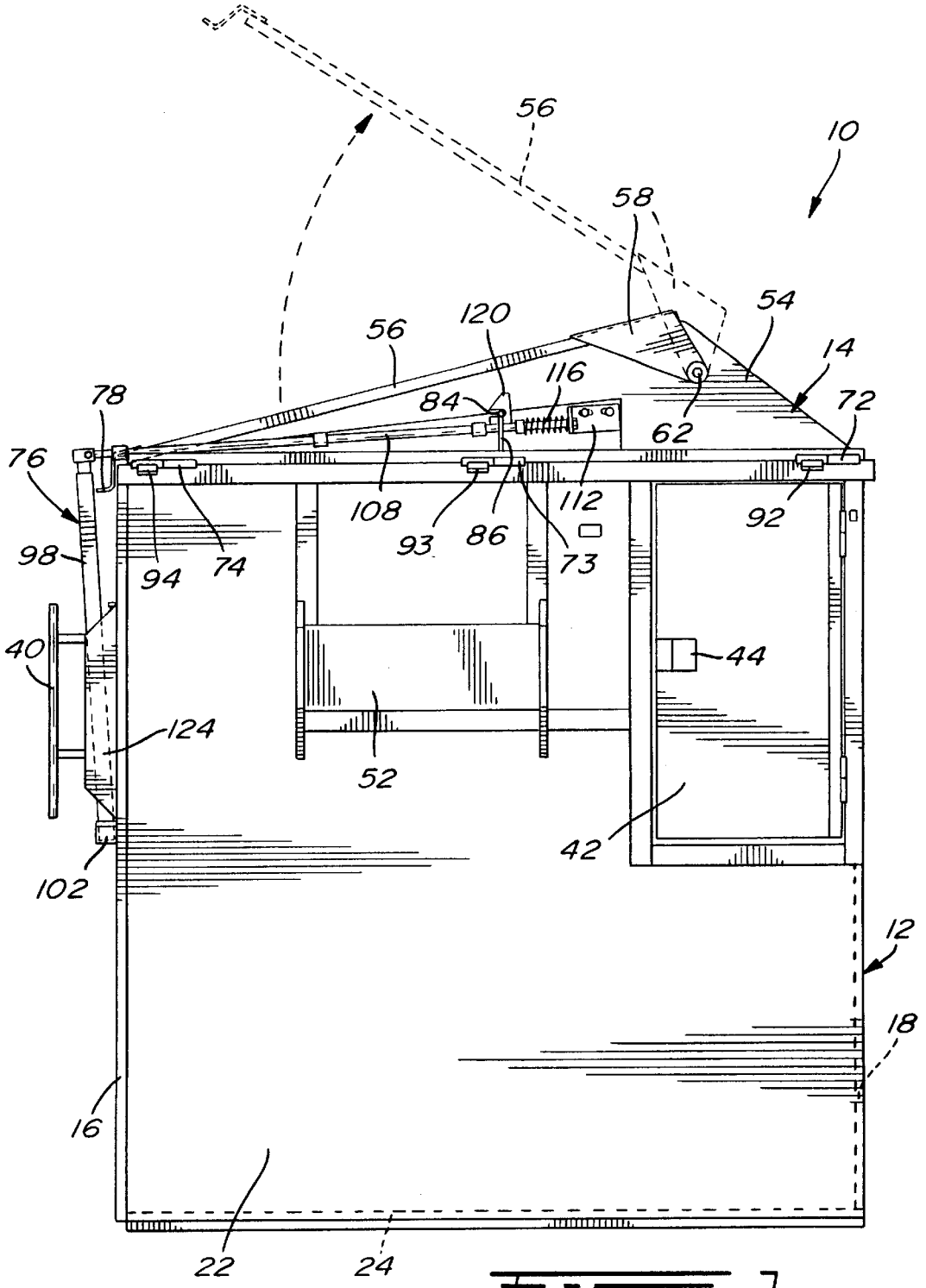
FIG. 1 is a side elevational view of a partitioned collection container according to an embodiment of the present invention.

Turning now to the appended figures, a partitioned collection container 10 according to a preferred embodiment of the present invention will be described.

The partitioned collection container 10 includes a body 12 and a lid assembly 14 mounted to the body 12.

The body 12 includes a front wall 16, a rear wall 18, first and second lateral walls 20, 22, a bottom wall 24 and first and second partition walls 26, 28. The partition walls 26, 28, together with the walls 16, 18, 20, 22 and 24 define a central compartment 30 positioned between two lateral compartments 32, 34.

Figure 2:
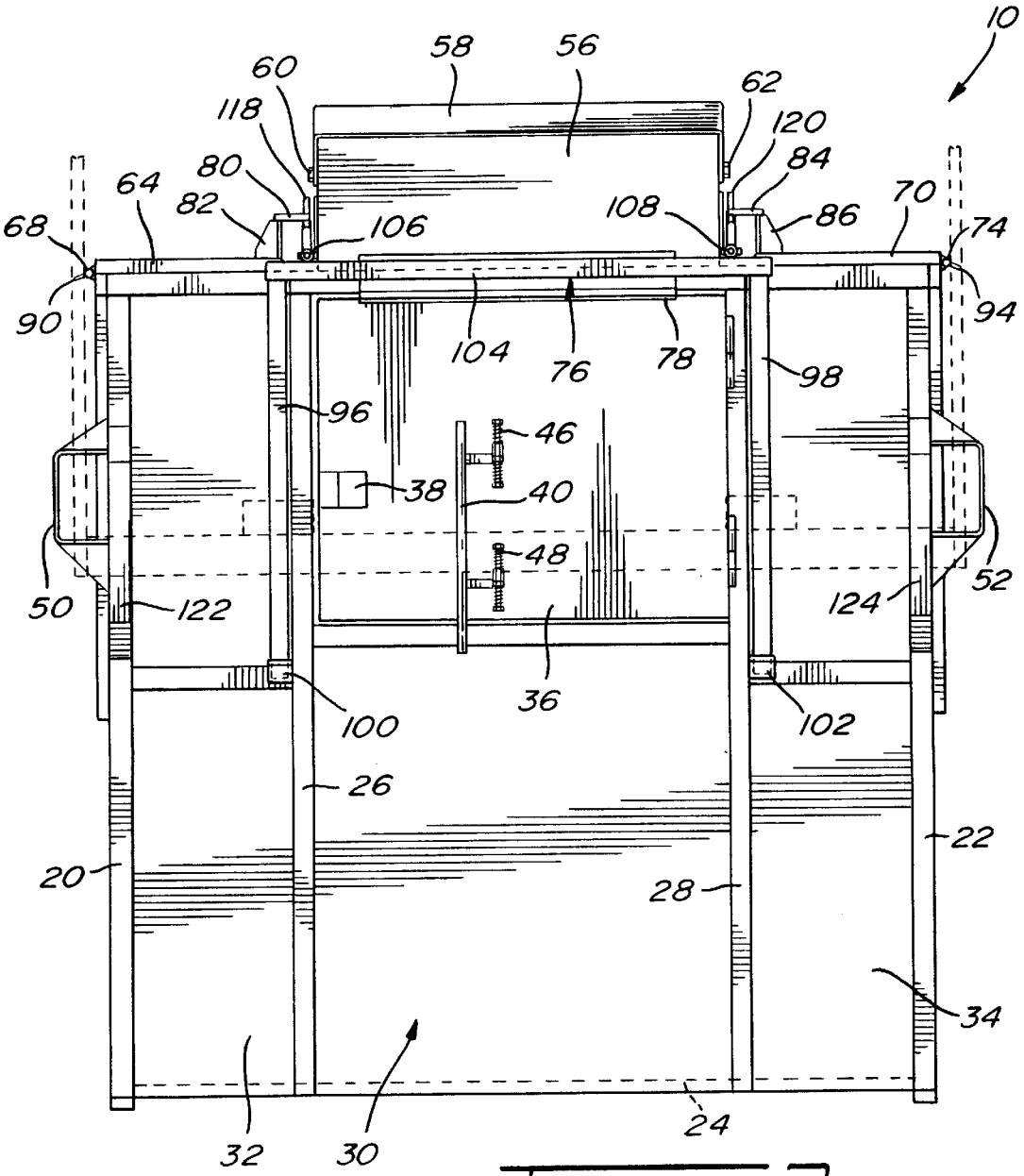
FIG. 2 is a front elevational view of the partitioned collection container of FIG. 1.

As can be better seen from FIG. 2, the front wall 16 includes a door 36 provided with a lock 38 and a pull handle 40. This door 36 enables users to put waste material into the central compartment 30. Similarly, the lateral wall 22 includes a door 42 (FIG. 1) provided with a lock/handle 44 enabling users to put waste material in the lateral compartment 34. Of course, the lateral wall 20 also includes such a door (not shown) enabling users to put waste material in the lateral compartment 32.

Figure 6:
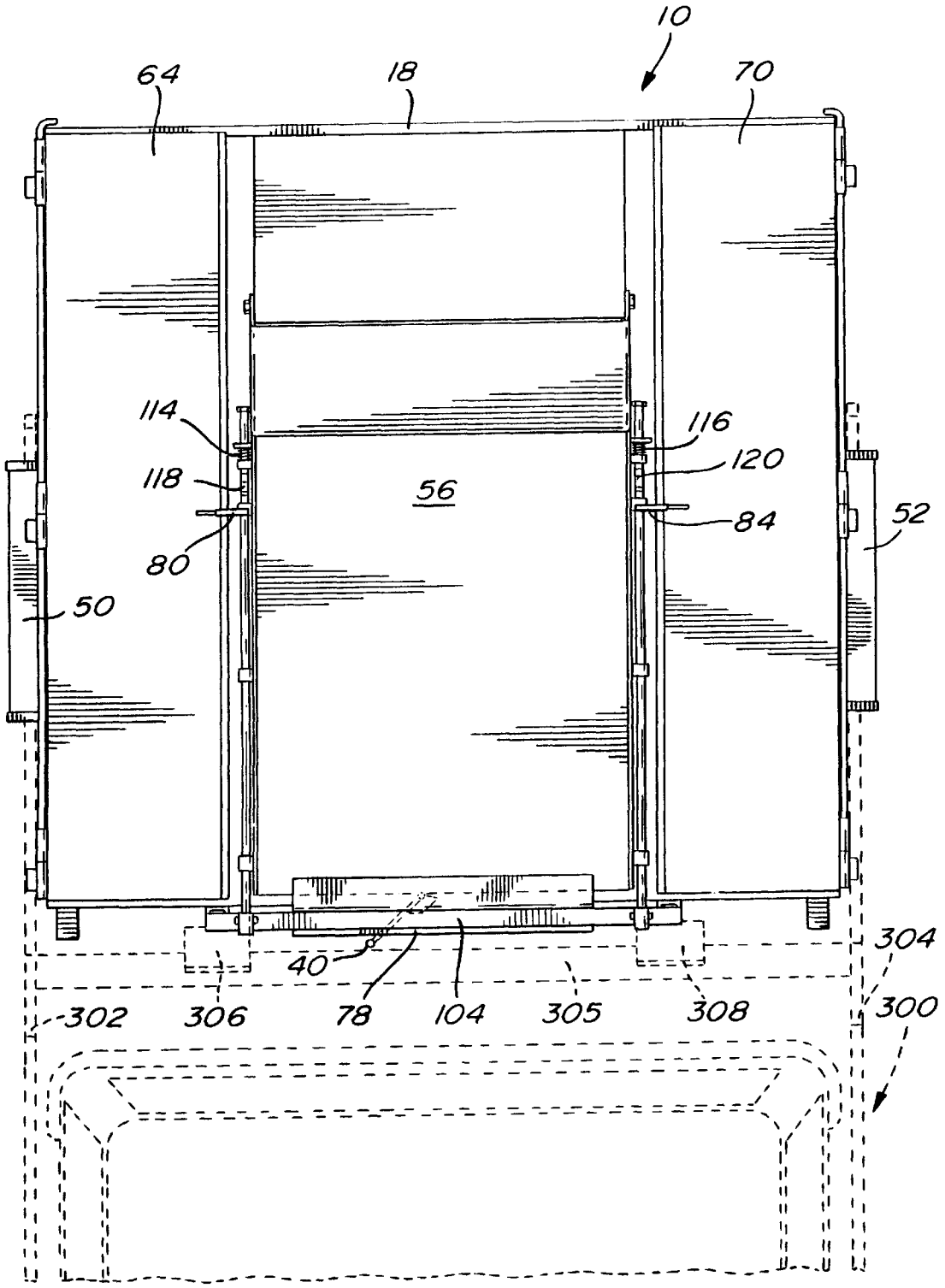
FIG. 6 is a top plan view of the partitioned collection container of FIG. 1 engaged by the lifting arms of a recyclable waste material collecting vehicle.

As will be apparent to one skilled in the art, the handle 40 is pivotable mounted to the door 38 so as to pivot between an extended position shown in FIG. 1, and a retracted position shown in FIG. 6. The handle 40 includes springs 46, 48 biasing the handle 40 towards its extended position.

The body 12 of the container 10 also includes lateral guides 50, 52 respectively mounted to the lateral sides 20, 22. The lateral guides 50, 52 allow the container 10 to be manipulated by the conventional lifting arms of waste material collecting vehicles as will be described hereinafter.

The lid assembly 14 includes a cover 54 fixedly mounted to the body 12 and provided with openings (not shown) to the compartments 30, 32 and 34. The lid assembly 14 also includes a first lid 56 pivotally mounted to the cover 54 via a hinge element 58 and pivot pins 60, 62 to close the opening of the compartment 30; a second lid 64 pivotally mounted to cover 54 in the proximity of the lateral side 20 via hinges 66, 67 and 68 to close the opening of the compartment 32; and a third lid 70 pivotally mounted to the cover 54 in the proximity of the lateral side 22 via hinges 72, 73 and 74 to close the opening of the compartment 34. The lid assembly 14 further includes a lid locking mechanism 76 mounted to the front wall 16 and to the cover 54.

Figure 4:
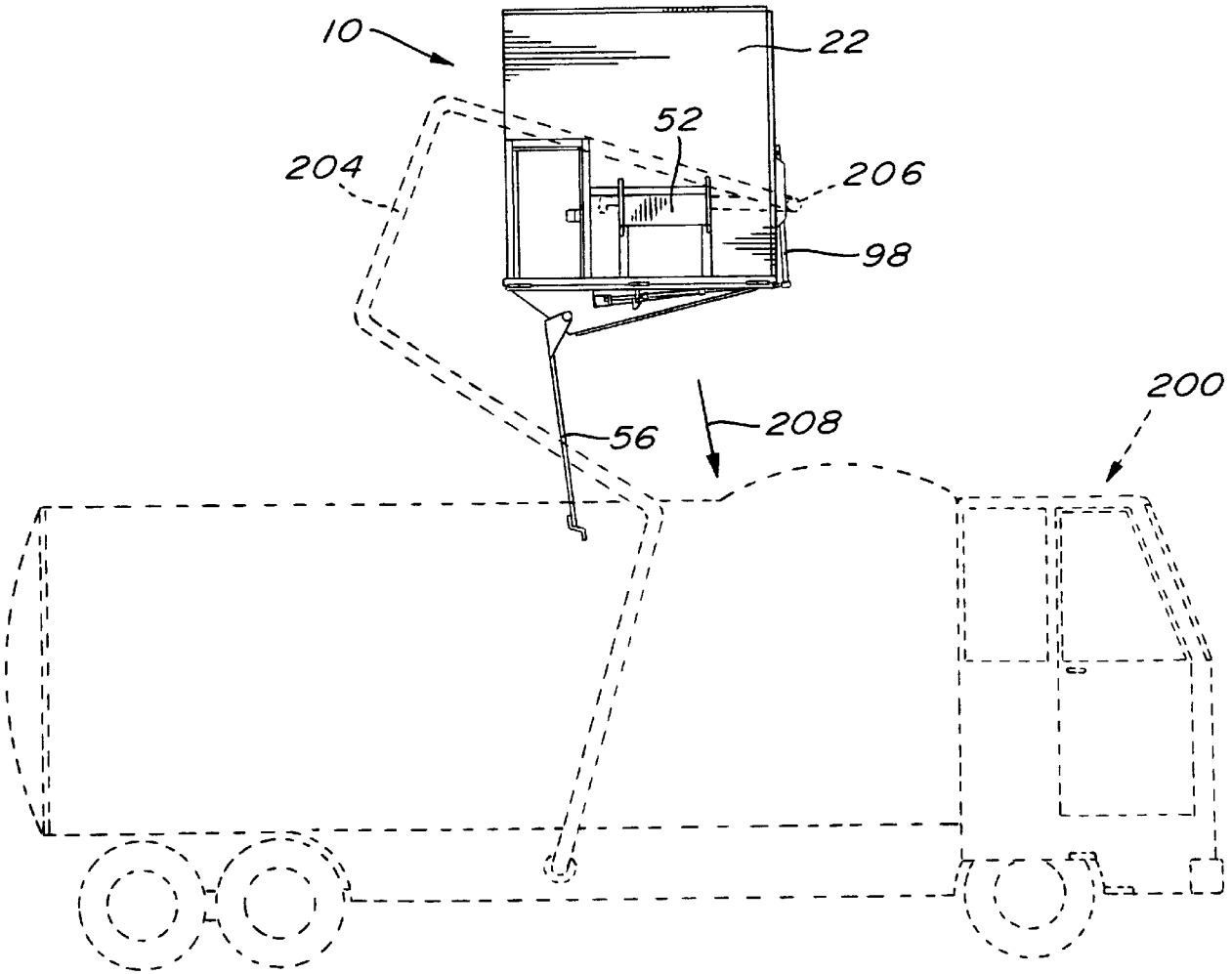
FIG. 4 is a side elevational view of the partitioned collection container of FIG. 1 engaged by the lifting arms of a non-recyclable waste material collecting vehicle and positioned to empty its central collecting compartment.

The first lid 56 may thus pivot about pivot pins 60, 62 between a closed position shown, for example, in full lines in FIG. 1 and an open position shown in dashed lines in FIG. 1 and in full lines in FIG. 4. The first lid 56 also includes a lip 78, the purpose of which will be described hereinafter.

Figure 7:
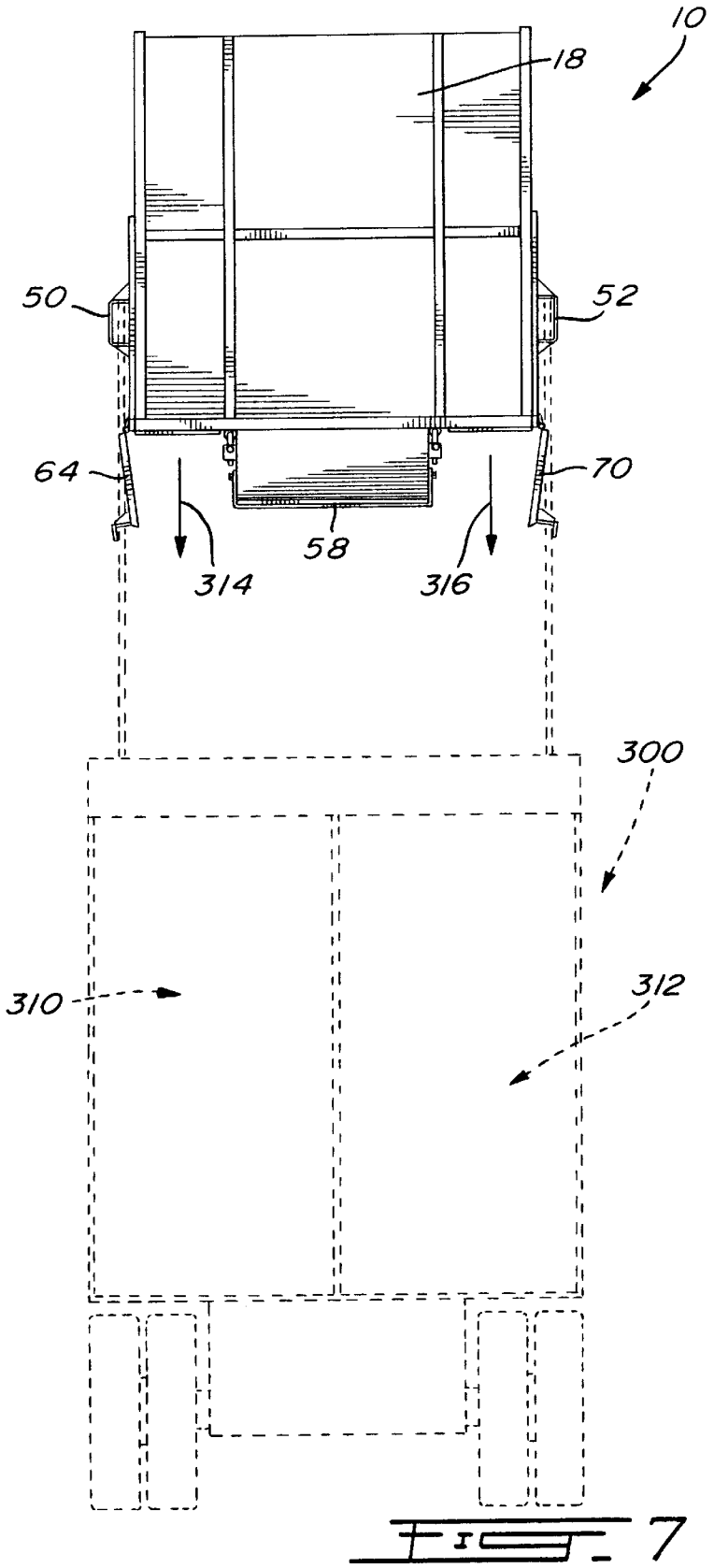
FIG. 7 is a rear elevational view of the partitioned collection container of FIG. 1 engaged by the lifting arms of a recyclable waste material collecting vehicle and positioned to empty its lateral collecting compartments into the separate compartments of the recyclable waste material collecting vehicle.

Similarly, the second and third lids 64, 70 may be pivoted about their respective hinges 66, 67, 68 and 72, 73, 74 between closed positions illustrated, for example, in FIG. 2 and open positions illustrated in FIG. 7.

The second lid 64 includes a projecting pin 80 fixedly mounted via a support 82, while the third lid 70 includes a projecting pin 84 fixedly mounted via a support 86. As will be described shortly, the projecting pins 80, 84 are provided to releasably lock the second and third lids 64, 70 in their closed positions, respectively.

To prevent excessive opening of the second and third lids 64 and 70, the hinges 66, 67, 68, 72, 73 and 74 are provided with respective stoppers 88, 89, 90, 92, 93 and 94 configured and sized to abut against the lateral sides when a predetermined open position is reached.

The lid locking mechanism 76 includes two push bars 96, 98 mounted to the front wall 16 via respective cube-shaped brackets 100, 102, a cross-bar 104 interconnecting the two push bars 96, 98 and two push-rods 106, 108 mounted between the cross-bar 104 and respective brackets 110, 112.

Figure 5:
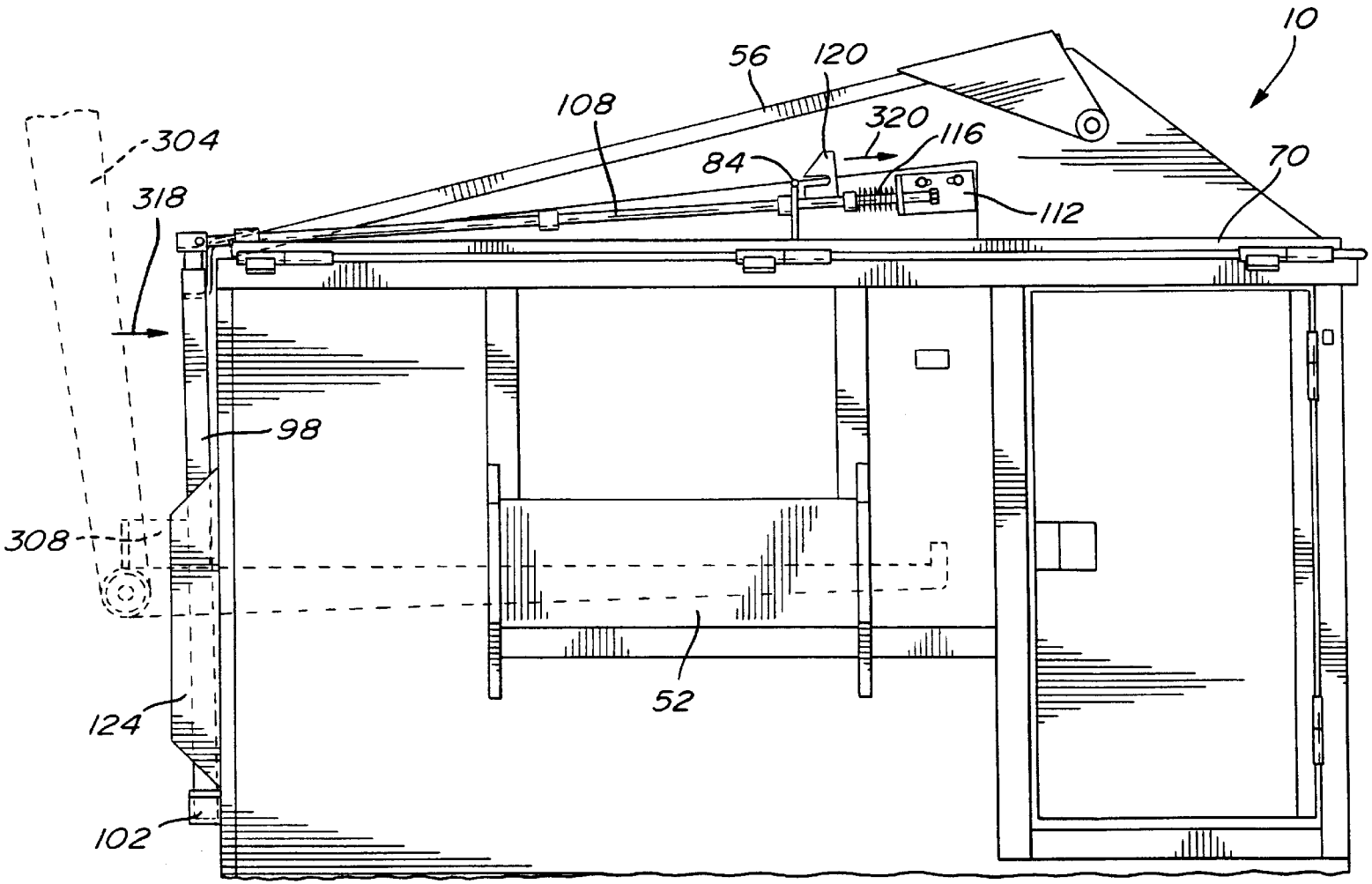
FIG. 5 is an enlarged side elevational view of the partitioned collection container of FIG. 1 engaged by the lifting arms of a recyclable waste material collecting vehicle.

The configuration and size of the cube-shaped brackets 100, 102 enable the push-bars 96, 98 to pivot between an extended position illustrated, for example, in FIG. 1 and a retracted position illustrated, for example, in FIG. 5.

The cross-bar 104, since it is fixedly mounted to the push-bars 96, 98, is accordingly moved between extended and retracted positions. When the cross-bar 104 is in its retracted position, it engages the lip 78 of the lid 56 to place the lid 56 in a locked state.

The push-rods 106, 108 are linearly movable between a locking position illustrated, for example, in FIG. 1 and a non-locking position illustrated, for example, in FIG. 5. Springs 114, 116 are respectively positioned between the push-rods 106, 108 and the corresponding brackets 110, 112 to bias the push-rods 106, 108 towards their locking position. Pin locking elements 118, 120 are fixedly mounted to a respective push-rod 106, 108 so as to be moved between a locking position illustrated, for example, in FIG. 1 and a non-locking position illustrated, for example, in FIG. 5.

The springs 114, 116 by biasing the push-rods 106 and 108 towards their locking position, therefore keep the second and third lids 64 and 70 in a normally locked position. Conversely, the springs 114, 116, by biasing the cross-bar 104 towards its extended position, keep the first lid 56 in a normally unlocked position.

The lid locking mechanism 76 also includes abutting elements 122, 124, the purpose of which will be described hereinbelow.

The operation of the partitioned collection container 10 will now be described with reference to FIGS. 3–7 of the appended drawings.

Figure 3:
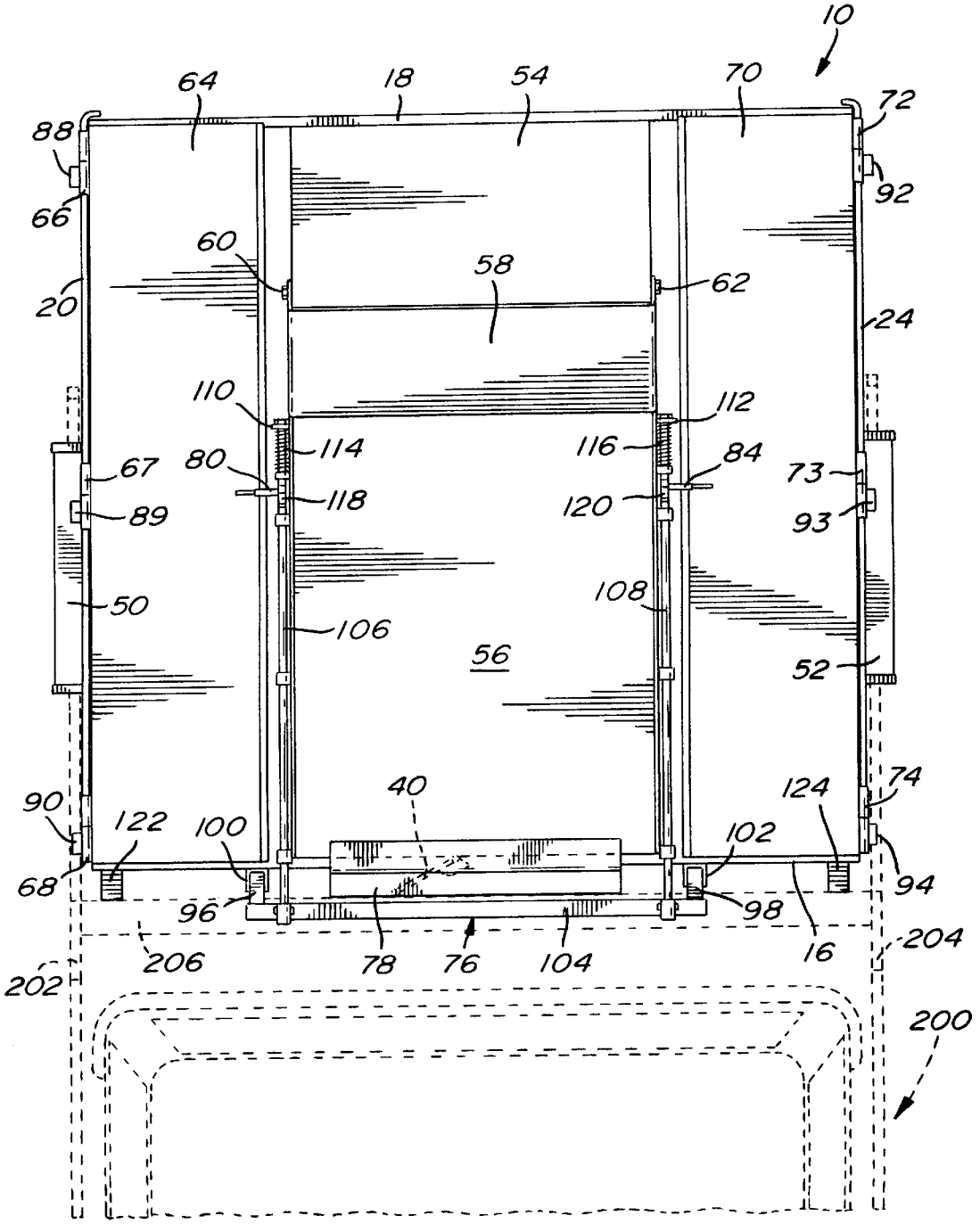
FIG. 3 is a top plan view of the partitioned collection container of FIG. 1 engaged by the lifting arms of a non-recyclable waste material collecting vehicle.

More specifically, FIGS. 3 and 4 illustrate the central compartment 30 of the partitioned collection container 10 being emptied in a conventional non-recyclable waste material collecting vehicle 200 shown in dashed lines, while FIGS. 5, 6 and 7 illustrate the lateral compartments 32 and 34 of the partitioned collection container 10 being emptied in a compartmented recyclable waste material collecting vehicle 300 shown in dashed lines.

It is to be noted that the vehicles 200 and 300 are schematically illustrated herein.

Turning now more specifically to FIGS. 3 and 4, the vehicle 200 includes conventional lateral lifting arms 202, 204 configured and sized to enter the lateral guides 50, 52 of the container 10. The lateral lifting arms 202 and 204 are interconnected by a cross-bar 206.

Since the vehicle 200 is intended to receive the content of the central compartment 30, the first lid 56 must remain unlocked while the second and third lids 64 and 70 must remain locked. As described hereinabove, the push-bars 96, 98 and the cross-bar 104 must remain in their respective extended positions for the above-noted results to be obtained. The abutting elements 122, 124 are therefore positioned and sized so as to stop the cross-bar 206 before it contacts the push-bars 96, 98.

As can be better seen from FIG. 4, the first lid 56 opens when the partitioned collection container 10 is turned upside-down by the lifting arms 202, 204. The content of the compartment 30 (see arrow 208) is therefore emptied into the vehicle 200.

Turning now to FIGS. 5, 6 and 7, two major differences exist between the vehicle 200 and the vehicle 300. Firstly, the cross-bar 305 interconnecting the lifting arms 302 and 304 is provided with push blocks 306, 308, configured, sized and positioned to push onto the push-bars 96, 98 of the lid locking mechanism 76. Secondly, the vehicle 300 includes two longitudinal compartments 310, 312 (FIG. 7) positioned to respectively receive the content of the compartments 32, 34 (see arrows 314 and 316) of the partitioned collection container 10.

As can be better seen from FIG. 5, the forward movement (see arrow 318) of the lifting arms 302, 304 cause the push blocks 306 and 308 to push onto the push-bars 96, 98 to therefore cause the longitudinal displacement of the push-rods 106,108 (see arrow 320) by compressing the springs 114,116. This displacement disengages the pin locking elements 118, 120 from the projecting pins 80, 84 to thereby unlock the second and third lids 64, 70. Similarly, the engagement of the projecting lip 78 by the cross bar 104 (see FIG. 6) locks the first lid 56 in its closed position.

FIG. 7 therefore illustrates the results of the manipulation of the partitioned collection container 10 by a suitable vehicle 300. Namely, the content of the lateral compartment 32 is emptied into the compartment 310 of the vehicle 300 while the content of lateral the compartment 34 is emptied into the compartment 312 of the vehicle 300.

It is to be noted that since the central compartment 30 is provided between the lateral compartments 32 and 34, it therefore serves as a buffer space ensuring that no mixing of the contents of the lateral compartments 32 and 34 occur during the transfer of the material from the container 10 to the vehicle 300.

As an example of application of the container 10, non-recyclable waste material could be collected in the central compartment 30 while fiber-containing recyclable material, for example paper and cardboard, could be collected in the lateral compartment 32 and non-fiber-containing recyclable material, for example plastic, metal and glass, could be collected in the lateral compartment 34. In this application, the buffer space created by the central container 30 prevents the different types of recyclable material contained in the lateral compartments 32 and 34 from being mixed when respectively transferred to the compartments 310, 312 of the recyclable material collecting vehicle 300.

As will be easily understood by one skilled in the art, since the central compartment 30 is used to collect garbage waste material, it needs to be emptied more often than the lateral compartments 32 and 34 used to collect recyclable material. In this case, the position of the lateral doors (only door 42 shown) of the compartments 32 and 34 in the rear portions of the lateral walls 20 and 22 is advantageous since the recyclable material (not shown) contained in the compartments 32 and 34 is moved towards the front wall 16, thus freeing the vicinity of the lateral doors, when the central compartment 30 is emptied. The lateral compartments 32 and 34 may therefore be adequately filled through relatively small lateral doors.

It is to be noted that since the stoppers 88–94 prevent the second and third lids 64 and 70 from excessive opening, these lids will pivot to their respective closed position when the container 10 is replaced on the ground. Indeed, without the stoppers 88–94, the second and third lids 64, 70 could open exceedingly which could lead to the failure to properly close.

It is also to be noted that each compartment 30, 32 and 34 includes a door, different from the lids 56, 64 and 70, intended to be operated by the users to put recyclable and non-recyclable waste material in the compartments 30, 32 and 34. This is an advantage since the lids 56, 64 and 70 are thus only openable by the vehicles 200 and 300 to therefore prevent overfilling of the compartments by the users.

Although the present invention has been described hereinabove by way of preferred embodiments thereof, it can be modified, without departing from the spirit and nature of the subject invention as defined in the appended claims.

I claim:

1. A partitioned collection container comprising:

a body provided with a front wall, a rear wall, two lateral side walls and a bottom wall; said body also including two internal partition walls defining a first compartment, a second compartment and a third compartment: said first compartment being a central compartment and said second and third compartments being lateral compartments;

a first lid hingedly connected to said body: said first lid is pivotable between a closed position where it closes said first compartment and an open position;

a second lid hingedly connected to said body: said second lid is pivotable between a closed position where it closes said second compartment and an open position;

a third lid hingedly connected to said body: said third lid is pivotable between a closed position where it closes said third compartment and an open position;

lid locking mechanism mounted to said body: said lid locking mechanism being associated with said first, second and third lids to allow one of said first lid or said second and third lids to open: said lid locking mechanism includes an actuator movable between an extended position and a retracted position; when said actuator is in one of said extended and retracted position, the first lid is in a locked state and the second and third lids are in an unlocked state; when said actuator is in the other of said extended and retracted position, the second and third lids are in a locked state and the first lid is in an unlocked state.

2. A partitioned collection container as recited in claim 1, wherein said second and third lids include respective projecting pins; said lid locking mechanism including means to selectively engage said projecting pins of said second and third lids to lock the second and third lids in their respective closed positions; said engaging means being connected to said actuator.

3. A partitioned collection container as recited in claim 2, wherein said actuator includes first and second push-bars pivotally mounted to said front wall of said body; said first and second push-bars being pivotable between a retracted position and an extended position; said actuator further including first and second push-rods associated with said first and second push-bars so that said pivoting of said push-bars between said retracted and extended positions cause the longitudinal displacement of said push-rods between respective unlocking and locking positions; said engaging means being mounted to said push rods.

4. A partitioned collection container as recited in claim 3, wherein said each engaging means include a pin locking element.

5. partitioned collection container as recited in claim 1, wherein said first lid includes a projecting lip; said lid locking mechanism including means to selectively engage said projecting lip to lock the first lid in said closed position; said engaging means being connected to said actuator.

6. A partitioned collection container as recited in claim 7, wherein said actuator includes first and second push-bars pivotally mounted to said front wall of said body; said first and second push-bars being pivotable between a retracted position and an extended position; said lip engaging means including a cross-bar provided between said first and second push-bars.

7. A partitioned collection container comprising:

a body provided with a front wall, a rear wall, two lateral side walls and a bottom wall; said body also including two internal partition walls defining a first compartment, a second compartment and a third compartment; said first compartment being a central compartment and said second and third compartments being lateral compartments;

a cover provided with first, second and third apertures respectively open to said first, second and third compartments;

a first lid hingedly connected to said cover; said first lid is pivotable between a closed position where it closes said first compartment and an open position; said first lid including a projecting lip;

a second lid hingedly connected to said cover; said second lid is pivotable between a closed position where it closes said second compartment and an open position; said second lid including a projecting pin;

a third lid hingedly connected to said cover; said third lid is pivotable between a closed position where it closes said third compartment and an open position; said third lid including a projecting pin; and lid locking mechanism mounted to said body and including:

first and second push-bars pivotally mounted to said front wall of said body; said first and second push-bars being pivotable between a retracted position and an extended position;

first and second push-rods associated with said first and second push-bars so that said pivoting of said push-bars between said retracted and extended positions cause the longitudinal displacement of said push-rods between respective unlocking and locking positions; each said first and second push-rod being provided with a pin locking element configured, sized and positioned to engage the projecting pin of one of said second and third lids when said first and second push-rods are in said locking position; and a cross-bar provided between said first and second push-bars and positioned to engage said projecting lip of said first lid when said first and second push-bars are in said retracted position to thereby prevent said first lid from opening;

whereby (a) when said first and second push-bars are in said retracted position said cross-bar prevent said first lid from pivoting to said open position and said first and second push-rods are in said unlocking position, therefore allowing said second and third lids to pivot to their respective open positions; and (b) when said first and second push-bars are in said extended position said cross-bar does not engage said projecting lip, therefore allowing said first lid to pivot to said open position and said first and second push-rods are in said locking position, therefore preventing said second and third lids from pivoting to their respective open positions.

* * * * *